US008403148B2

(12) United States Patent
Lubbers

(10) Patent No.: US 8,403,148 B2
(45) Date of Patent: Mar. 26, 2013

(54) METHOD OF SORTING DOCUMENTS OF VALUE

(75) Inventor: Dirk T. A. M. Lubbers, Giesbeek (NL)

(73) Assignee: De La Rue International Limited, Basingstoke (GB)

( * ) Notice: Subject to any disclaimer, the term of this patent is extended or adjusted under 35 U.S.C. 154(b) by 1275 days.

(21) Appl. No.: 12/219,760

(22) Filed: Jul. 28, 2008

(65) Prior Publication Data

US 2009/0026116 A1 Jan. 29, 2009

Related U.S. Application Data

(63) Continuation-in-part of application No. 11/878,078, filed on Jul. 20, 2007, now abandoned.

(51) Int. Cl.
*B07C 5/00* (2006.01)

(52) U.S. Cl. ..... 209/534; 209/583; 194/206

(58) Field of Classification Search ..... 209/583, 209/584, 900, 534; 196/206, 207; 270/52.04, 270/52.05

See application file for complete search history.

(56) References Cited

U.S. PATENT DOCUMENTS

| | | | | |
|---|---|---|---|---|
| 5,917,930 | A | 6/1999 | Kayani et al. | |
| 7,131,593 | B2 | 11/2006 | Steinkogler et al. | |
| 7,146,245 | B2 | 12/2006 | Jones et al. | |
| 2002/0040865 | A1 | 4/2002 | Steinkogler et al. | |
| 2005/0086271 | A1 * | 4/2005 | Jones et al. | 707/200 |
| 2007/0078560 | A1 | 4/2007 | Jones et al. | |

FOREIGN PATENT DOCUMENTS

| | | | |
|---|---|---|---|
| EP | 1 785 953 | A2 | 5/2007 |
| WO | WO 98/05006 | A1 | 2/1998 |

* cited by examiner

*Primary Examiner* — Joseph C Rodriguez
*Assistant Examiner* — Kalyanavenkateshware Kumar
(74) *Attorney, Agent, or Firm* — Oliff & Berridge, PLC

(57) ABSTRACT

A method of sorting documents of value includes a) forming a stack of documents of value, the including two or more batches of documents of value, each batch of documents of value being provided with first and second separators to separate the batch from an adjacent batch; and, b) sequentially feeding all the documents in the stack through a sorting machine to inspect the documents and to sort the documents into one or more output stations in dependence upon the results of the inspection, and sorting all first separators to a separator output station.

28 Claims, 5 Drawing Sheets

METHOD OF SORTING DOCUMENTS OF VALUE

This is a Continuation-in-Part of application Ser. No. 11/878,078 filed Jul. 20, 2007. The disclosure of the prior application is hereby incorporated by reference herein in its entirety.

The invention relates to methods of sorting documents of value, particularly banknotes and the like.

Highly automated, high-volume processing systems for documents of value are used in a variety of applications for which currency processing is particularly important. Several designs of high-volume processing machines are available in the prior art and used by such varied interests as national central banks, independent currency transporting companies, currency printing facilities, and individual banks.

In a typical process, a stack of banknotes is fed through a sorting machine past various detectors which detect certain characteristics of each document and then the documents are transported to at least one output station of which one may be a reject station depending upon the outcome of the detection process. For example, a currency processing machine can perform the simple tasks of processing a stack of currency in order to ensure that it is all of one denomination with proper fitness characteristics while simultaneously counting the stack to confirm a previous accounting. A slightly more complex task of separating a stack of currency into individual denominations while simultaneously counting the currency can be accomplished as well. At the more complex end of the prior art currency processing machines, a stack of currency consisting of various denominations can be fed into the machine for a processing that results in the separation of each denomination, a rejection of any currency that does not meet fitness specifications, the identification of counterfeit bills, and the tracking of individual notes by serial number.

In order to achieve accountability, it is common practice to form the stack of sheets to be sorted from a sequence of batches of documents, each batch being sandwiched between separators defining respective header and trailer documents, the header document typically identifying the source of the documents of value in the batch or the like. The stacked batches are then fed sequentially through the sorting machine with rejected documents, for example failing a denomination, fitness or authenticity test, being fed to a reject station while accepted documents are fed to one or more output stations. In addition, the header and trailer documents are also fed to the reject station so that any rejected documents remain sandwiched between the associated header and trailer. In order to reduce the number of rejects, which may have been caused by errors in the processing, it is common practice to refeed all the documents, including header and trailer documents, in the reject station through the sorting machine. After this second and any subsequent pass, the contents of the reject station have to be manually reviewed to locate rejected documents of value, which would be sandwiched between their associated header and trailer documents, and thus record the source or other information relating to the rejected document. In many cases, however, there will be no rejected documents and so associated header and trailer documents will be found side by side.

An example of a sorting method utilizing header and trailer documents is described in U.S. Pat. No. 5,917,930.

The problem with this known process can be understood when considering the processing of a typical high volume of banknotes of say 6,000,000 banknotes. This will be made up in a typical case of about 30,000 batches of 200 banknotes each together with 60,000 header and trailer cards (2 per batch). After the first pass, with a 1% reject rate, 60,000 notes will be rejected into the reject station together with all 60,000 header and trailer cards. On the second pass, with for example a 20% reject rate, 12,000 banknotes will be sorted into the reject station together with 60,000 header and trailer cards. This results in 72,000 documents in the reject station amongst which are 12,000 rejected banknotes.

In accordance with a first aspect of the present invention, a method of sorting documents of value comprises:

a) forming a stack of documents of value, the stack including two or more batches of documents of value, each batch of documents of value being provided with first and second separators to separate the batch from an adjacent batch; and, b) sequentially feeding all the documents in the stack through a sorting machine to inspect the documents and to sort the documents into one or more output stations in dependence upon the results of the inspection, sorting all first separators to a separator output station, and feeding all documents defined to be rejects, and only those second separators associated with rejects, to a reject station.

In this aspect of the invention, in step b) all first separators are sorted to a separator output station and effectively off-sorted. In this specification, when an output station is configured as a "separator output station" it only receives separators. This substantially reduces the number of items that need to be handled, typically manually, from output stations that receive second separators following the sorting process. In particular, the first separators are fed to a different, separator output station, so as not to be mixed in with the rejected documents. Furthermore, the number of second separators in the reject output station is confined to only those associated with rejected documents.

In some cases, step b) comprises feeding all documents defined to be rejects together with all second separators to a reject station. This still achieves a reduction in the number of separators in the reject station in comparison with the prior art process described above and thus makes manual sorting easier. For example, in connection with the specific example mentioned above, if the inventive method is applied during the second pass, along with the 12,000 rejected banknotes, there will be a maximum of 12,000 second separators (headers) i.e. one rejected banknote per batch and no first separators (trailers). This results in a maximum of 24,000 items to be reviewed as opposed to the 72,000 in the traditional process.

In some cases, it may be more difficult manually to keep track of the different batches having documents in the reject station because there will be no second separators in the reject station corresponding to those batches with no rejects. However, as explained below, the separators themselves may provide some form of identification or alternatively (or additionally) the sorting machine itself can track the movement of separators during the full sorting process and thus can identify the batches associated with each separator in the reject station.

Typically, those second separators not associated with rejected documents are fed to the or to another separator output station.

In this case, all the first separators and those second separators not associated with rejected documents are off-sorted to the same or different separator output stations where they can be conveniently collected for future use since separator output stations only receive separators as mentioned above.

In some cases, the first and second separators are identical. This is particularly convenient when constructing a stack of documents although for processing, the sorting machine will need to be provided with information relating to each batch in the stack in the order in which it appears in the stack so that the processing of each batch can be properly monitored.

It is preferable, therefore, for at least the second separators to be distinguishable from the first separators. This makes it easier for the sorting machine to handle the processing of separators. The distinction between the first and second separators may be achieved by virtue of one or more of their shape and indicia provided thereon. For example, the first and/or second separators could be provided with laterally protruding tabs and if both types of separator are provided with tabs, these could be located in different positions. Additionally, or alternatively, the first and second separators could have different thicknesses and indeed in general all separators will have a thickness different from that of the documents of value which again assists the sorting machine in distinguishing between separators and documents.

Alternatively, or additionally, each second separator may carry an identifier. In its simplest form, the identifier is common i.e. non-unique, to all second separators and simply identifies the item as a second separator. The sorting machine can identify each batch if it has been preloaded with the order of batches and corresponding batch identifying information.

In more preferred examples, each second separator is distinguishable from each other second separator and again this may be achieved by virtue of one or more of their shape, thickness and indicia carried thereon. Thus, each second separator may be provided with data defining an identifier that is unique to each second separator. In this case other information about the batch can be stored electronically in or accessible to the sorting machine with reference to the identifier. In an alternative arrangement, the second separator carries that data. In either case the data may provide one or more of an identification of the source of the documents of value in the associated batch, batch document denomination (s), piece count(s), user who prepared batch, machine that prepared batch and time at which batch was prepared. In some cases, certain data may be stored electronically and other data be provided on the second separator.

Preferably, the data is machine readable and may be provided by optically and/or magnetically readable indicia.

It should be appreciated that in the above discussion, the second separators are used in different ways to provide more information about batches while the first separators are not. This is preferred because the second separators are not off-sorted to the separator output station. However, it is also possible that the first separators are provided with this additional information since the sorting machine can track the processing of batches, as explained above.

In the examples described so far, each batch is associated with first and second separators. This is advantageous because it makes it much less likely that mis-sorting of documents will occur as there will be two separators (a first separator from one batch and a second separator from another batch) adjacent one another for each pair of adjacent batches.

Nevertheless, with increased accuracy of sorting machines, the use of two separators is not always necessary. Thus, in accordance with a second aspect of the present invention, a method of sorting documents of value comprises:

a) forming a stack of documents of value, the stack including two or more batches of documents of value, each batch of documents of value being provided with a separator to separate the batch from an adjacent batch; and, b) sequentially feeding all the documents in the stack through a sorting machine to inspect the documents and to sort the documents into one or more output stations in dependence upon the results of the inspection, wherein one of the output stations comprises a reject station to which documents identified by the sorting machine as rejects and separators associated with the rejected documents are fed, and sorting all separators associated with batches having no rejected documents to a separator output station.

In this case, a single separator is associated with each batch thus halving the number of separators that need to be processed. Furthermore, all separators associated with batches having no rejected documents are off-sorted to the separator output station thus achieving the same benefit as explained above with a reduction in the number of separators in the reject station.

In both aspects of the invention, steps a) and b) preferably comprise the last pass in a series of two or more passes of document stacks through the sorting machine. In each case, the contents of the reject station from one pass are used to form the stack in the next pass.

In this case, the designation of the output stations may be changed between the passes to accommodate different types of sorting process, for example if only a limited number of output stations are available and one or more has to be used for different purposes in different passes.

The sorting process will typically be based on one or more of authenticity, fitness and denomination although other sorting conditions could also be used. Examples include issuer (country or issuing bank), issue (series), and authenticity broken down for example between genuine/not recognised/suspected (probable) counterfeit, requiring manual confirmation.

The documents of value typically comprise banknotes but other examples include, cheques, tickets (for example as dispensed in casinos), substitute currency media, and vouchers and also combinations of different types of documents of value.

The sorting machine can take any conventional form. The same separator output station can be used for off-sorting both first and second separators or separate separator output stations could be provided. Furthermore, one of the output stations used for receiving documents could also be used as the separator output station. For example, where documents are sorted according to condition then all documents having a satisfactory condition together with off-sorted separators could be fed to the same output station.

Some examples of methods according to the invention will now be described with reference to the accompanying drawings, in which.

Figure 1:
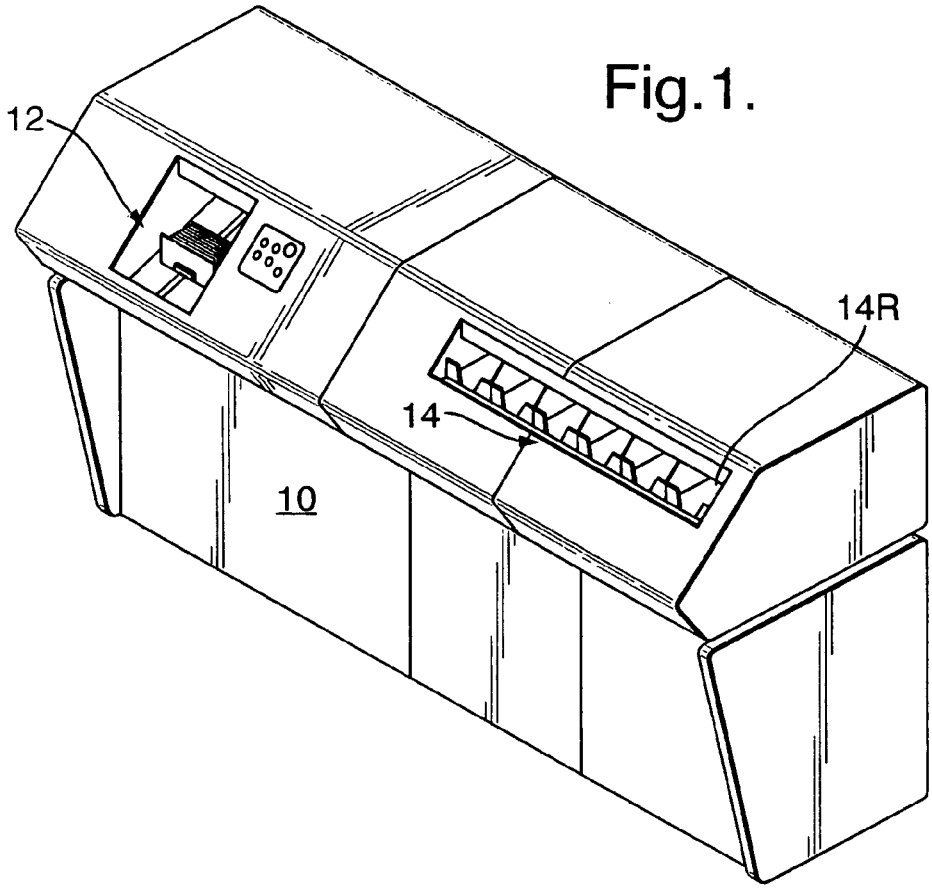
FIG. 1 is a perspective view of a currency sorting machine loaded with a stack of currency and separators.

FIG. 1 shows a currency sorting machine 10 for carrying out embodiments of the present invention and loaded with a stack of batches of currency 12 prior to starting the currency processing cycle. This stack 12 is fed into the currency sorting machine one single note at a time. Single notes then travel on a conveyor (not shown) past several different detectors (not shown) before being deposited in one of the sort bins or output stations 14 or a destruction device such as a shredder (not shown). Typically, a single sort bin is used to accumulate a single denomination of note at the end of the sort process. One of the sort bins 14R is used as a reject station or bin. A control system (not shown) controls operation of the machine 10.

Figure 2:
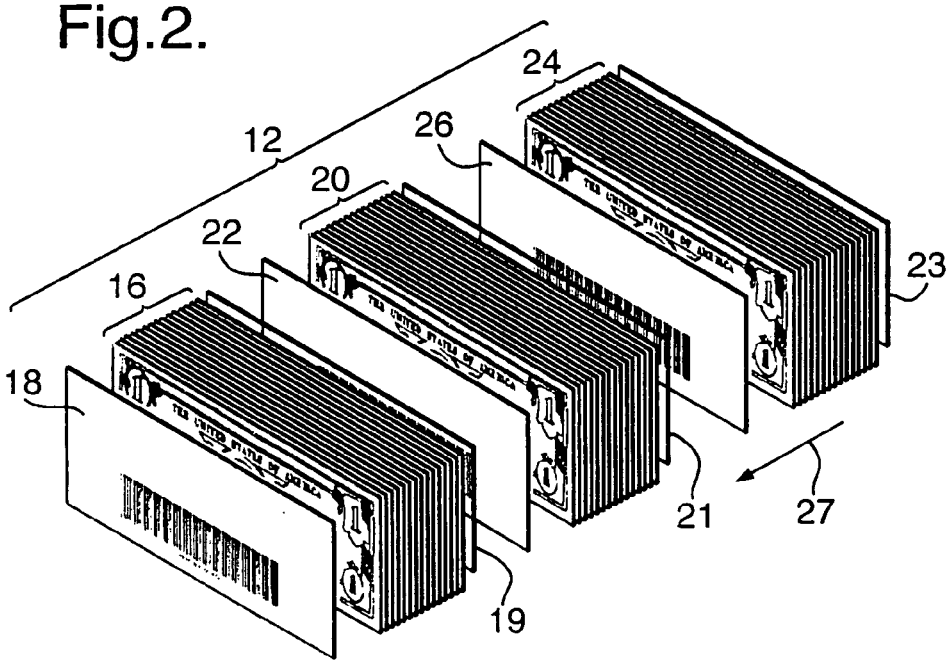
FIG. 2 is a perspective view of a stack of currency divided by separators.

FIG. 2 illustrates part of a typical stack of banknotes formed by a sequence of individual batches. In FIG. 2, a batch 24 is followed by a batch 20 which is followed by a batch 16. A "first" separator document 19, 21, 23 is provided at the downstream side of each batch 16, 20, 24 respectively while each batch is provided with an associated "second" separator or batch process document 26, 22, 18 respectively positioned on the upstream side of the batch with respect to a processing direction indicated by an arrow 27. Thus each first separator document 19, 21, 23 acts as a trailer and each second separator document 26, 22, 18 acts as a header.

Figure 3A:
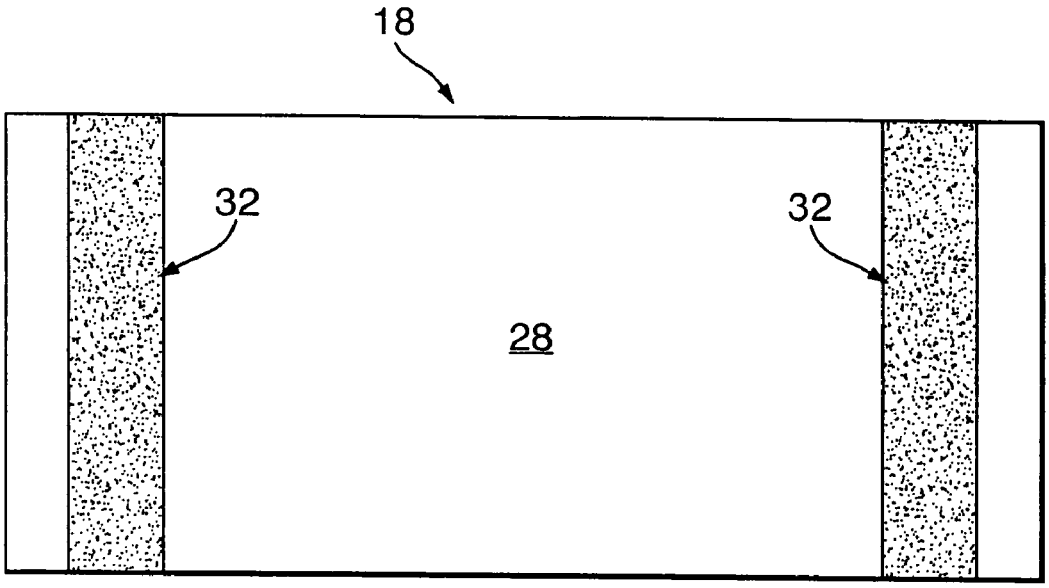
FIG. 3A is a plan view of the front of a "second separator" or batch process document.
Figure 3B:
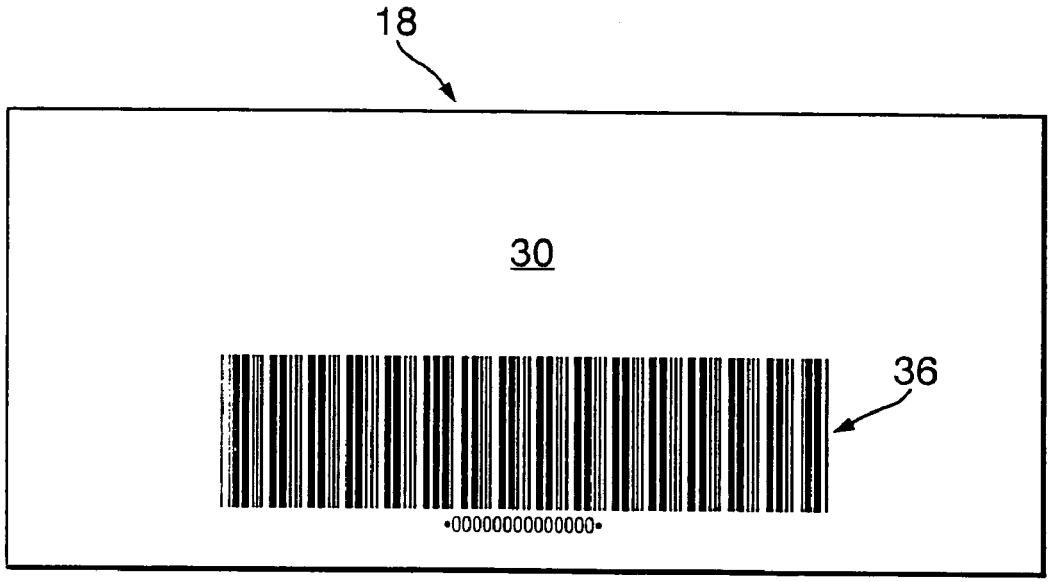
FIG. 3B is a perspective view of the back of a "second separator" or batch process document.

FIGS. 3A and 3B depict an exemplar batch process document 18. FIG. 3A shows the first side 28 of the document 18, while FIG. 3B shows the second side 30 of the document 18. In the embodiment shown by FIGS. 3A and 3B, the first side 28 is overlaid with a first magnetic strip 32 and a second magnetic strip 34. The second side 30 is imprinted with a bar code. This embodiment allows for accurate identification of a batch process document 18 primarily by detection of the two magnetic strips 32, 34. Typically this arrangement of magnetic strips 32, 34 will be the same on each batch process document or second separator while each first separator will have a different arrangement of magnetic strips or no magnetic strips so it can be distinguished from a second separator. Usually all first separators will be identical. Accounting data on an individual batch of currency can be identified to a specific bar code number encoded on the bar code 36 of the batch process document 18. Thus, each second separator will have a unique bar code which can be used to address a table in the processor of the machine 10 to enable accounting data prestored by the processor to be accessed. Alternatives to magnetic strips include RFID chips, OCR codes and the like. Examples of accounting data include one or more of an identification of the source of the documents of value in the associated batch, batch document denomination(s), piece count(s), user who prepared batch, machine that prepared batch and time at which batch was prepared.

Figure 4:
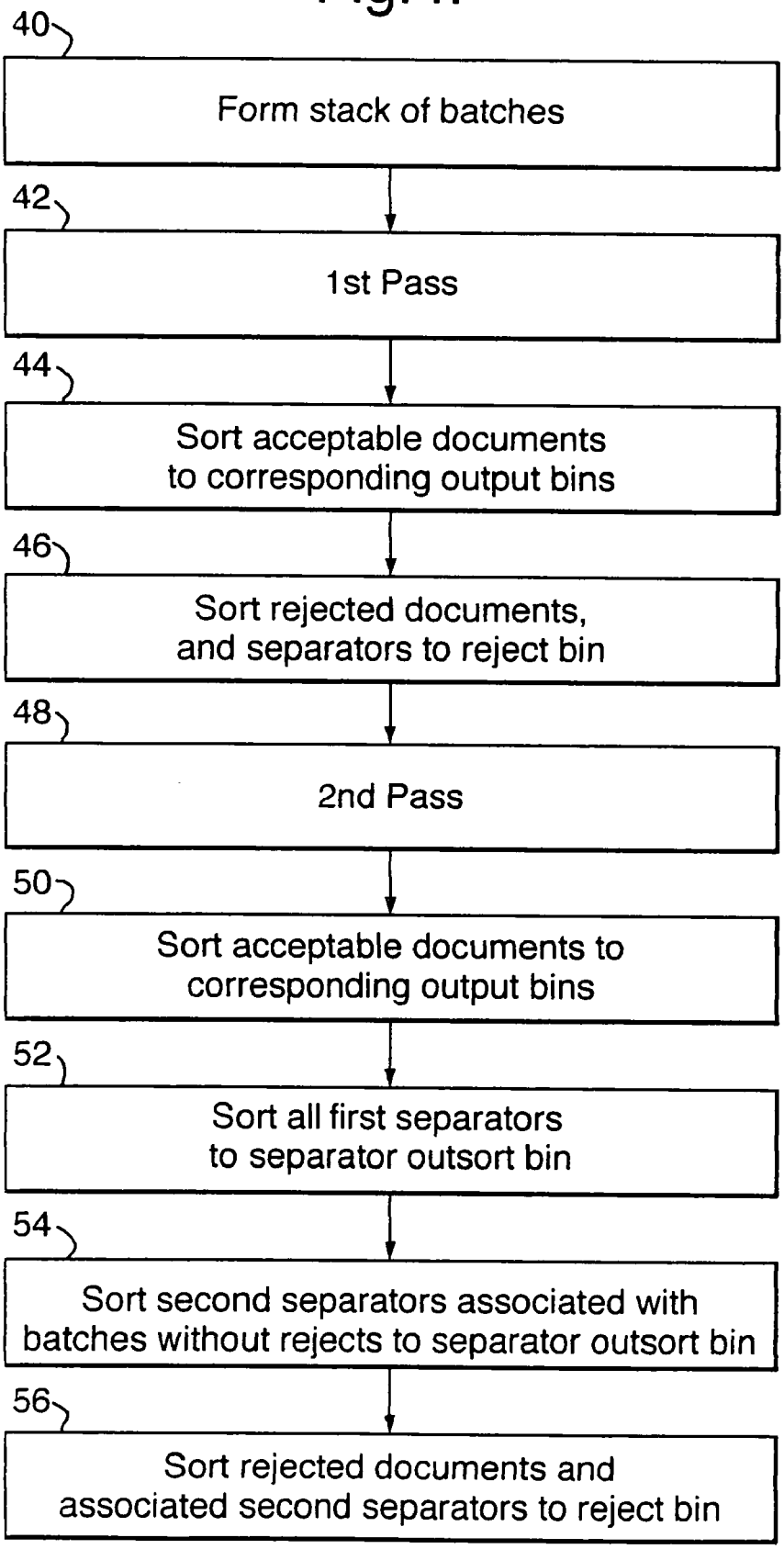
FIG. 4 is a flow chart of a method for processing currency.

An example of a method of processing a stack of documents in the form described above will now be described with reference to FIG. 4. It should be understood, however, that the handling of the information read from each batch process document will not be described in detail since any conventional methods can be used as described for example in U.S. Pat. No. 5,917,930, U.S. Pat. No. 7,131,593 B2 and U.S. Pat. No. 7,146,245 B2 incorporated herein by reference.

Initially, step 40, a stack of batches is formed as shown in FIG. 2. Each batch process document or second separator 18, 22, 26 is provided with accounting data relating to the associated batch of banknotes, or more typically that information is stored by the processor of the machine 10 at an address corresponding to the unique i.d. of the separator 18, 22, 26.

The stack is then fed in a first pass 42 through the sorting machine 10. During this sorting process, detectors within the machine 10 inspect each banknote and the separator documents. For example, a detector may be provided for determining the denomination of each banknote and another detector for determining authenticity. If a banknote is found to be authentic and its denomination can be determined, it will be directed to a particular output bin for stacking genuine banknotes with that denomination (step 44). All other documents either non-genuine or unreadable banknotes or separators are fed to the reject bin (step 46).

The stacked separators and banknotes in the reject bin are then removed by the operator and processed again in a second pass 48 through the sorting machine. In the second pass, the contents of the reject bin are refed, typically at a slower rate than in the first pass, through the sorting machine which again feeds genuine and readable banknotes to corresponding output bins (step 50). However, during the second pass, the sorting machine 10 acts differently when it detects the passage of first and second separators. Firstly, all the first separators, when detected, are fed to an out sort or separator output bin (step 52) formed by one of the bins 14 that only receives separators.

Secondly, any of the second separators which are detected and which are associated with batches without any rejected banknotes are also fed to the same separator outsort bin as the first separators. Alternatively, they could be fed to a second separator output bin (step 54).

Finally, all remaining rejected banknotes and second separators are fed to the reject bin (step 56). The contents of the reject bin are then manually processed as described above.

In the examples described above, the second separator documents 18, 22, 26 precede their associated batches of banknotes as they are fed sequentially through the sorting machine. It is possible, however, for the first separator documents 19, 21, 23 to be fed first, the sorting machine storing information about the banknotes in a temporary store pending feeding of the associated second separator document which can then be used to correlate the information with the appropriate batch.

In the examples described so far, each batch of documents 16, 20, 24 is associated with first and second separator documents. This minimises the risk of the sorting machine overlooking a separator document since there will always be two such documents in sequence between successive batches. However, it is not essential to provide two separators to a batch and in other examples, a single separator per batch could be provided. This is illustrated in FIG. 5 where it will be seen that the previous "first" separator documents 19, 21, 23 have been omitted.

Figure 6:
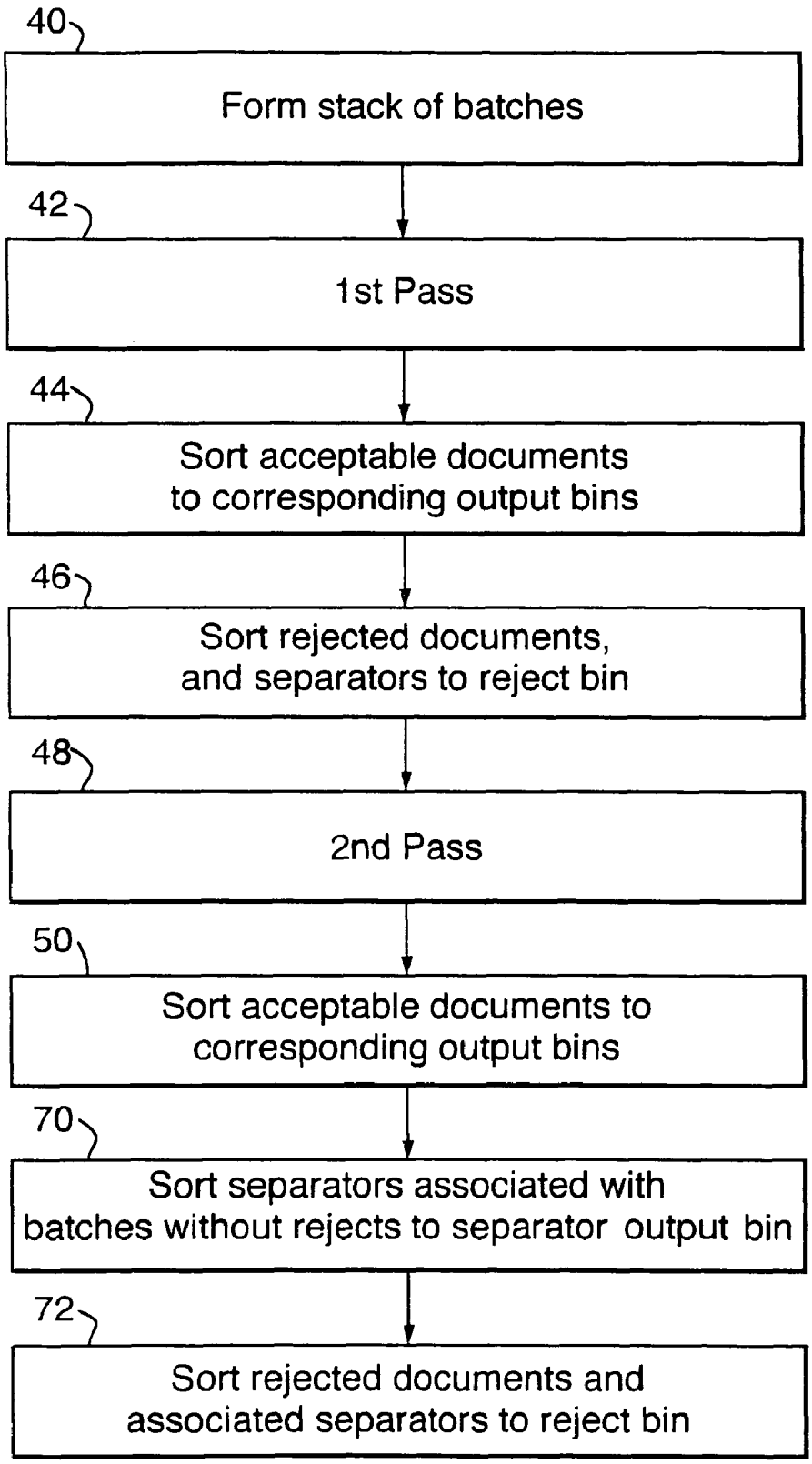

A method of processing a stack of banknote batches associated with single "second" separators will now be described with reference to FIG. 6. In this case, a stack of batches is formed as shown in FIG. 6 (step 40) and then in a first pass 42, the documents in the stack are sorted so that acceptable documents are fed to corresponding output bins (step 44) while rejected documents and all separators are fed to a reject bin (step 46). Thus, the first pass process is similar to that described in FIG. 4.

The contents of the reject bin are then re-fed through the sorting machine in a second pass 48. In this second pass, acceptable documents are fed to corresponding output bins for example according to their denomination (step 50) while separators associated with batches without rejected banknotes are fed to a separator output or outsort bin (step 70) and rejected documents and associated separators are fed to the reject bin (step 72).

Figure 5:
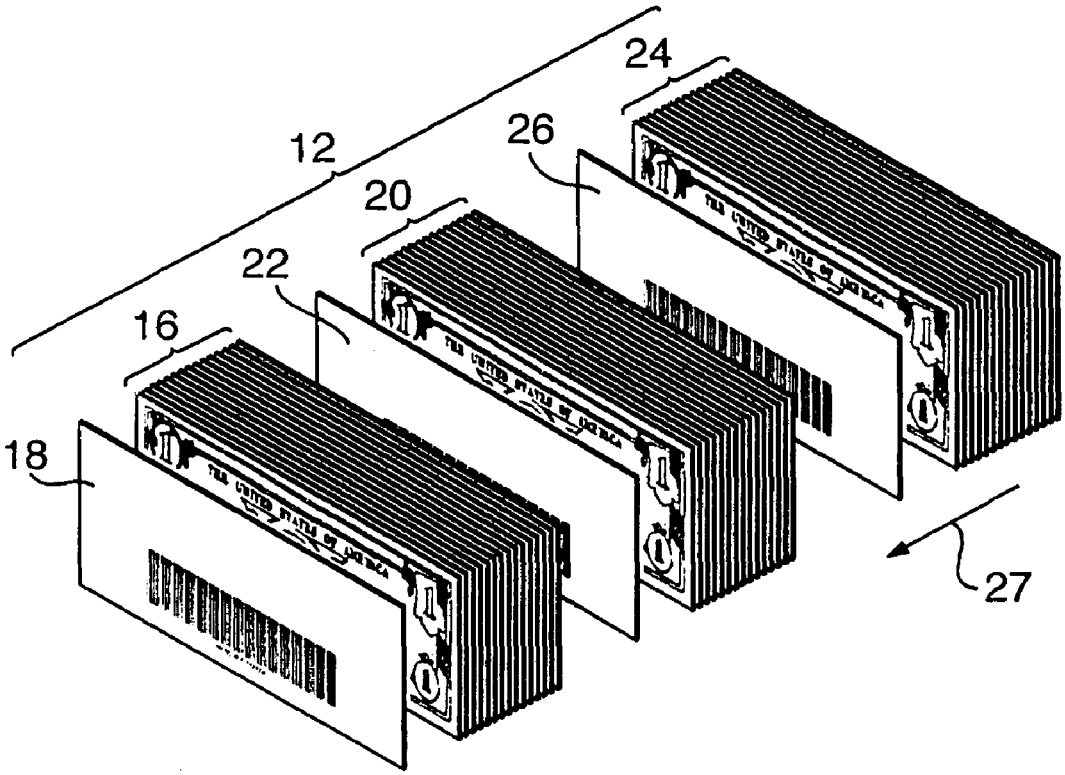
FIG. 5 is a view similar to FIG. 2 but illustrating a stack of currency divided by single separators; and, FIG. 6 is a flow chart illustrating a method of processing the stack of documents shown in FIG. 5.

In a modification of this process, the batches in FIG. 5 could be separated by identical "first" separators, the sorting machine keeping track of the batches simply from prior knowledge of the order of batches in the stack.

The various methods described above involve two passes. This is to maximise the chances of automatically accepting banknotes. Further passes, in which steps corresponding to the first pass in each case, could be carried out prior to the final pass corresponding to the second pass. Furthermore, the "first pass" could be omitted in some cases and the banknotes sorted in a single pass following the steps of the appropriate "second pass" described above.

In the examples described above, the banknotes are processed in two passes with the action of the machine being different on the second pass from the first pass. It is therefore necessary to ensure that the machine knows that it is to operate in accordance with the "second pass" and there are various ways in which this could be achieved. The simplest approach is for the operator to indicate directly to the control system, for example by depressing a control button or the like, that the second pass is to be commenced.

In another approach, where separators such as Header separators are used which are individually identifiable, the machine could automatically detect that it has already processed (in the first pass) the first header separator fed in the second pass and immediately switch to the second pass process. Similarly, if each Trailer separator or other separator is uniquely identified a similar process could be adopted.

In a further example, the stack of banknotes and separators ready for the second pass could be preceded by a special "second pass" document or card which will be detected by the machine or such a document or card could be provided at the end of the initial stack of banknotes in the first pass so that the machine automatically prepares itself for the second pass following the first pass.

The invention claimed is:

1. A method of sorting documents of value, the method comprising:

a) forming a stack of documents of value, the stack including two or more batches of documents of value, each batch of documents of value being provided with first and second separators to separate the batch from an adjacent batch; and, b) sequentially feeding all the documents in the stack through a sorting machine to inspect the documents and to sort the documents into one or more output stations in dependence upon the results of the inspection, sorting all first separators to a separator output station, and feeding all documents defined to be rejects, and only those second separators associated with rejects, to a reject station.

2. A method according to claim 1, wherein, prior to step a), the method further comprises: forming an initial stack of said documents of value, the stack including two or more batches of documents of value, each batch of documents of value being provided with first and second separators to separate the batch from an adjacent batch, sequentially feeding all the documents in the stack in a first pass through the sorting machine to inspect the documents and to sort the documents into the one or more output stations in dependence upon the results of the inspection, and sorting all documents defined to be rejects together with all separators to a reject station;

and utilizing the contents of the reject station to form the stack of documents of value to be used in step a).

3. A method according to claim 2, wherein the designation of the output stations is changed between the first pass and the second pass defined by step b).

4. A method according to claim 1, wherein those second separators not associated with rejected documents are fed to the separator output station or to another separator output station.

5. A method according to claim 1, wherein the first and second separators are identical.

6. A method according to claim 1, wherein the second separators are distinguishable from the first separators.

7. A method according to claim 6, wherein the second separators are distinguishable from the first separators by virtue of one or more of their shape and indicia provided thereon.

8. A method according to claim 6, wherein each second separator is distinguishable from each other second separator.

9. A method according to claim 8, wherein the second separators are distinguishable from each other by virtue of one or more of their shape and indicia carried thereon.

10. A method according to claim 9, wherein each second separator carries indicia related to the associated batch.

11. A method according to claim 10, wherein the indicia relate to one or more of the source of the batch, denomination of documents in the batch, number of documents in the batch, document values, and the like.

12. A method according to claim 7, wherein indicia on the separators are machine readable, comprising optically and/or magnetically readable indicia.

13. A method according to claim 1, wherein the sorting machine is adapted to track the movement of at least those separators associated with documents identified to be rejects.

14. A method of sorting documents of value, the method comprising:

a) forming a stack of documents of value, the stack including two or more batches of documents of value, each batch of documents of value being provided with a separator to separate the batch from an adjacent batch; and, b) sequentially feeding all the documents in the stack through a sorting machine to inspect the documents and to sort the documents into one or more output stations in dependence upon the results of the inspection, wherein one of the output stations comprises a reject station to which documents identified by the sorting machine as rejects and only those separators associated with the rejected documents are fed, and sorting all separators associated with batches having no rejected documents to a separator output station.

15. A method according to claim 14, wherein prior to step a), the method further comprises: forming an initial stack of said documents of value, the stack including two or more batches of documents of value, each batch of documents of value being provided with a separator to separate the batch from an adjacent batch, sequentially feeding all the documents in the stack in a first pass through the sorting machine to inspect the documents and to sort the documents into the one or more output stations in dependence upon the results of the inspection, and sorting all documents defined to be rejects together with all separators to the reject station;

and utilizing the contents of the reject station to form the stack of documents of value to be used in step a).

16. A method according to claim 15, wherein the designation of the output stations is changed between the first pass and the second pass defined by step b).

17. A method according to claim 14, wherein the separators are identical.

18. A method according to claim 14, wherein each separator is distinguishable from each other separator.

19. A method according to claim 18, wherein the separators are distinguishable from each other by virtue of one or more of their shape and indicia carried thereon.

20. A method according to claim 19, wherein each separator carries indicia related to the associated batch.

21. A method according to claim 20, wherein the indicia relate to one or more of the source of the batch, denomination of documents in the batch, number of documents in the batch, document values, and the like.

22. A method according to claim 19, wherein indicia on the separators are machine readable, comprising optically and/or magnetically readable indicia.

23. A method according to claim 14, wherein the sorting machine is adapted to track the movement of at least those separators associated with documents identified to be rejects.

24. A method according to claim 1, wherein the sorting machine sorts the documents of value in accordance with one or more of authenticity, fitness and denomination.

25. A method according to claim 1, wherein the documents of value comprise banknotes.

26. A method according to claim 1, wherein the documents of value comprise cheques.

27. A method according to claim 1, wherein the documents of value comprise banknotes and cheques.

28. Apparatus for sorting documents of value, the apparatus comprising:

a document transport;

means for determining one or more characteristics of the documents;

at least two output stations; and a control system adapted to carry out the method according to claim 1.

* * * * *